United States Patent [19]

Nesbitt

[11] 3,973,678

[45] Aug. 10, 1976

[54] DISPLAY BRACKETS

[75] Inventor: George G. Nesbitt, Denver, Colo.

[73] Assignee: Denver Wood Products Co., Denver, Colo.

[22] Filed: Mar. 5, 1975

[21] Appl. No.: 555,467

[52] U.S. Cl. ..... 211/106; 211/59; 211/181; 248/DIG. 3

[51] Int. Cl.[2] ..... A47F 5/08

[58] Field of Search ..... 211/54, 57, 59, 104, 211/106, 112, 119, 181, 130, 60 T, 61; 248/DIG. 3; 40/13

[56] References Cited

UNITED STATES PATENTS

| | | | |
|---|---|---|---|
| 680,450 | 8/1901 | Aiken | 211/181 UX |
| 746,573 | 12/1903 | Pynchon | 211/119 |
| 1,767,545 | 6/1930 | Mossbacher | 211/106 |
| 1,848,950 | 3/1932 | Hammes | 40/13 X |
| 2,286,831 | 6/1942 | Ressinger | 211/181 X |
| 2,471,349 | 5/1949 | Reiss | 211/104 X |
| 2,547,239 | 4/1951 | Walker | 40/13 |
| 2,666,530 | 1/1954 | Beren | 211/104 X |
| 3,333,710 | 8/1967 | Steingold | 211/181 X |
| 3,485,382 | 12/1969 | Larson | 248/DIG. 3 X |
| 3,501,015 | 3/1970 | Behles | 248/DIG. 3 X |

OTHER PUBLICATIONS

German Printed Application F 15574 VII/11e Jacoby, 8/30/1956.

*Primary Examiner*—Roy D. Frazier
*Assistant Examiner*—Thomas J. Holko
*Attorney, Agent, or Firm*—C. B. Messenger

[57] ABSTRACT

A bracket for extension from a wall type support to provide improved display, access and organization for bulky items stored for sale. A plurality of arms extend laterally from a main trunk support that is itself engaged through an opening at the wall element for extension outwardly and downwardly from the point of wall engagement. The arms that extend laterally and then forwardly from the point of trunk attachment are formed of bent wire material with the arms of one embodiment being formed serially from a continuous strip of wire bent on itself at each arm and coursing along the main trunk between separate arms. An index tag is engaged to offset portions of each arm for pivoting movement to collapsed storage and upstanding display positions in a manner providing reinforcing support for said arms and the sale items engaged on the horizontally disposed forepieces of each arm.

4 Claims, 10 Drawing Figures

DISPLAY BRACKETS

BACKGROUND OF THE INVENTION

Modern merchandising procedures utilize display stands or gondolas placed about the floor areas of sales outlets in an organization of aisles or viewing areas so that the customers will have direct access to the items being sold. Effective sales presentation requires an organized arrangement of the various lines of goods so the separate items in each line of goods are attractively displayed. When this type of display stand is used, items of small size may be conveniently packaged in separate receptacles, and a wide range of size and color options can generally be accommodated in an efficient and compact manner. Sale items of intermediate size or of irregular contour represent a special problem for merchandising display especially where an extensive range of sizes is required. Automotive items, such as drive belts and hoses, are difficult to display in a manner that provides consumer access and sales appeal. The problems are increased when compact storage and inventory control are also desired. Because of such problems the manufacturers of items that are hard to display generally must provide point-of-sale display structures that will satisfy not only the customer requirements but that will also conform to the even more stringent needs and requirements of merchandisers. Specially built display structures that do not conform to the size and appearance of regularly used display equipment engender initial sales resistance on the part of the merchandiser. Non-conforming display racks also seem to have a shorter in-store life. Since gondola type display racks which optionally provide support for shelves or brackets are predominantly used at present, it is desirable to provide a display bracket for use with bulky items that is adaptable for use with such gondola type displays. Further, since most of the gondola displays have an upright Pegboard type support, it is desirable that a display bracket be provided that will be fully compatible with the gondola units now already in place at many sales outlets.

SUMMARY OF THE INVENTION

The present invention is directed to the provision of a display bracket that is compatible with Pegboard type wall or gondola supports and that can be placed to extend outwardly therefrom. Since a plurality of bulky items that will have a considerable total weight are to be held and supported in display position for ready customer access, a strong and serviceable bracket is provided. A main support of bent wire construction provides a plurality of hooks that are engageable through openings of the Pegboard and a forwardly and downwardly extending trunk. Bent wires that may be of lesser gauge are disposed along such trunk support and are welded thereto at spaced positions to provide laterally extending arms in an echelon disposition along the main trunk. In one embodiment where all of the arms and interconnecting trunk extension segments are formed of a single piece of wire, each of the arms has separate extension and return flights that are bent to provide forepieces and end stops for each arm disposed forwardly of lateral segments of such arms. For all embodiments of the invention, the provided forepieces are generally parallel to the main trunk support, but they are at an angle thereto that provides a horizontal disposition of the forepieces when the main trunk is engaged on a support wall in its forwardly and downwardly extending position. With such arrangement the echelon positioning of the arms exposes top segments of items stored on the arms for ready customer access. Index tab elements that can hold item identifying and inventory information and prices are positioned on each arm. Such tabs are engaged to offset portions of the arms, and they are pivotally movable to storage and display positions. In the display position the tabs provide support for the arms and any sale items engaged thereon. In the storage position the tabs are out of the way, and a plurality of brackets may be handled, stored or shipped in nested compact arrangement. A separable brace component is provided for selective engagement with the main trunk of the bracket and the pegboard support when excess item loadings are to be accommodated.

DESCRIPTION OF THE PREFERRED EMBODIMENTS

Figure 1:
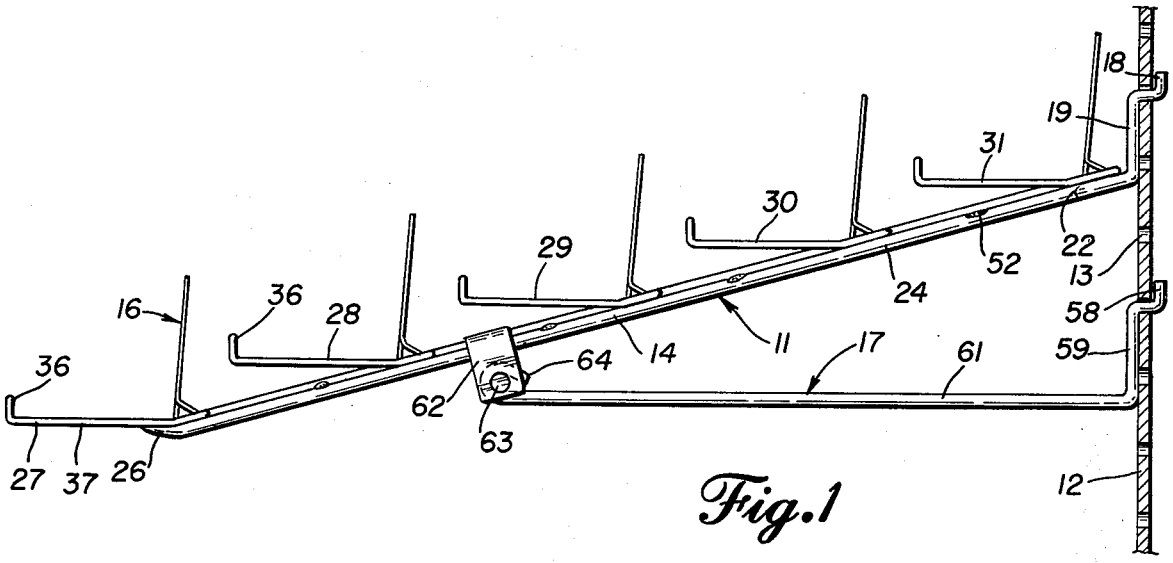
FIG. 1 is a side elevation of a first embodiment of the invention showing a bracket in the display position.
Figure 2:
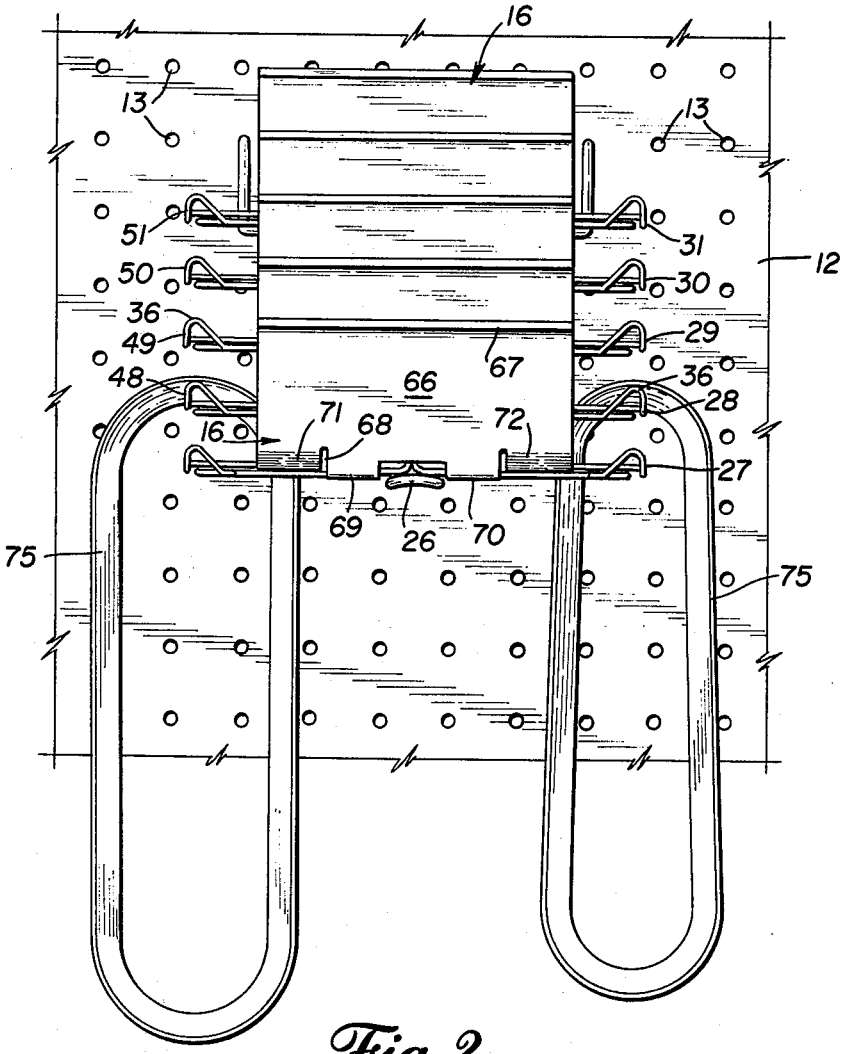
FIG. 2 is a front elevation of such bracket.

A first embodiment of the invention is shown in FIGS. 1 through 5. The display bracket shown in these Figures is of composite construction. The main elements of the construction are of bent wire, and, accordingly, the bracket 11 may be economically fabricated on a mass production basis. The bracket 11, as illustrated in FIGS. 1 and 2, is intended for use on a Pegboard type of wall support structure 12. The Pegboard support 12, which is preferably disposed in an upright position, has a plurality of openings 13 provided in a regulated pattern so that hooks, brackets, support shelves or the like may be engaged through the Pegboard openings to hold such brackets or shelves in desired positions.

The particular bracket 11 illustrated is intended for use in connection with the display of bulky items that may conjointly be of considerable weight. For such items that are also of substantial bulk, the display on a Pegboard system has been rather difficult and usually only a minor number of sizes could be displayed without taking up a considerable area of sales space. In order to provide storage and display space for a greater number of individual items, bracket 11 extends outwardly from the board wall support a considerable distance.

Figure 3:
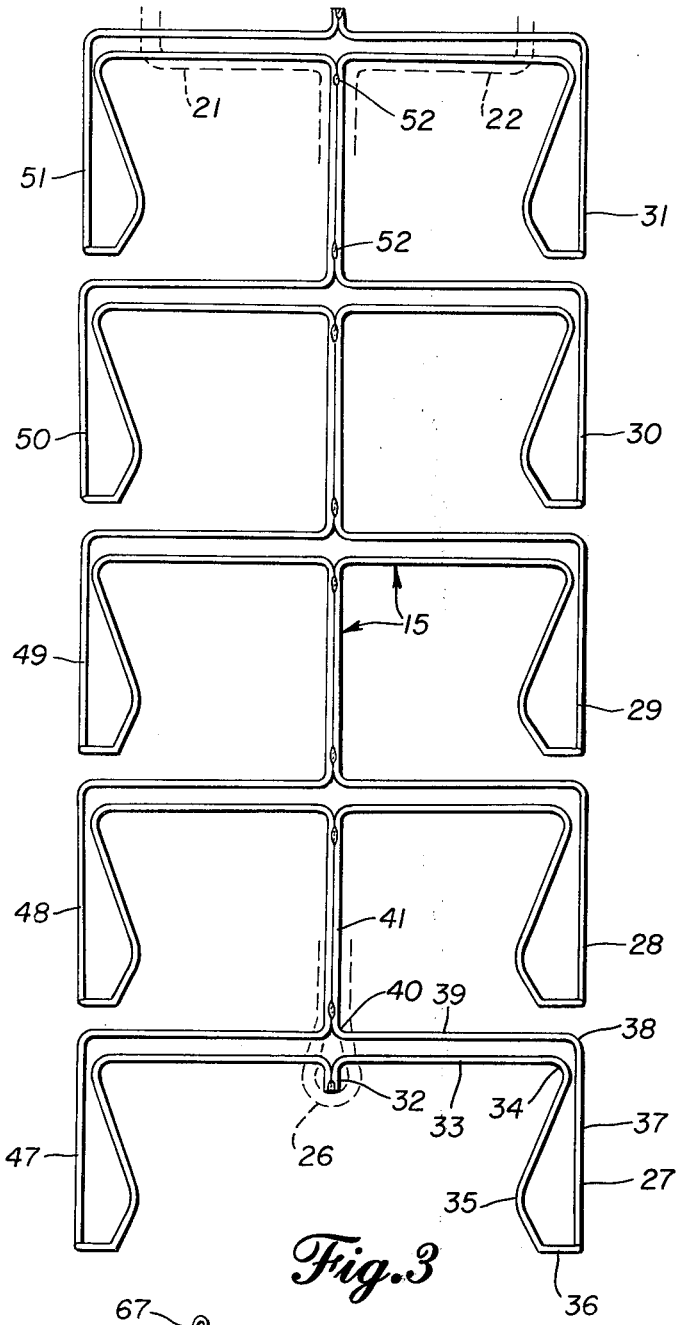
FIG. 3 is a partial top plan view showing features of the bent wire arm components.
Figure 4:
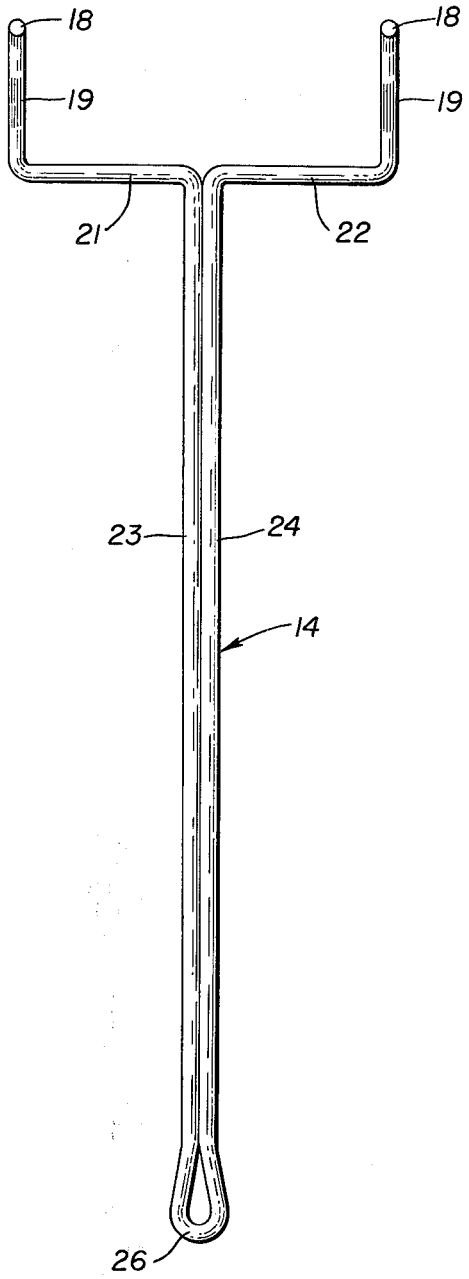
FIG. 4 is a partial top plan view showing the main trunk support, said support being shown in a slightly shifted position when compared with the showing of FIG. 3.

The actual construction of bracket 11 is best explained by reference to the drawings provided. The main trunk support 14 for the bracket 11 is shown in FIG. 4. The layout pattern for the laterally extending arm component 15 is shown in FIG. 3. Such components are used in combination with the index tabs 16 of FIG. 5 and the support brace 17 shown in FIG. 1 to provide the total bracket construction. The main support trunk 14 is of a bent wire construction wherein the wire used is of approximately No. 6 gauge so that hook ends 18 thereof may be extended through the openings 13 of the pegboard 12. Inwardly from the hook ends 18 the main trunk component 14 is bent to provide a stop segment 19 that will be disposed against the face of the board when the spaced apart hooks 18 are engaged in separate spaced openings 13 and when the main trunk 14 is in its forwardly and downwardly extending attitude shown in FIG. 1. Left and right lateral segments 21 and 22 interconnect the hooks 18 and the stop segments 19 to longitudinal members 23 and 24 that are joined by a loop segment 26 for disposition in a paired side-by-side relationship.

The separate item supporting arms of arm component 15 are also of bent wire construction, but the wire stock is of smaller diameter. The successive arms 27, 28, 29, 30 and 31 that will be disposed on the right when they are joined to the main support trunk 14 are all formed of a single length of wire that is bent in the distinctive pattern shown in FIG. 3. For the forwardmost support arm 27 an initial stub 32 is provided which engages with the loop 26 of main trunk support 14. From the stub 32 an extension segment 33 of arm 27 extends outwardly and is then bent at an elbow 34 to extend forwardly and slightly inwardly to provide a knob 35. At its forwardmost extent the wire stock is bent upwardly and then outwardly to provide item retaining stops 36. A return segment of the arm construction includes a rearwardly continuing section 37, a companion elbow bend 38 and a return flight 39. A bend 40 at the main trunk position connects to a trunk extension section 41 coursing along main trunk 14. Similar bends and sections are subsequently derived to successively and serially provide the arms 28 through 31. The entire left bank of arms 47 through 51 are formed in similar manner and in a symmetrical pattern. The arm component 15 is welded together at spaced positions 52 along the length thereof, and such arm component is also welded at such positions to the main trunk support 14.

When the assembled support bracket 11 is to be used for the support of heavy objects, it is desirable that a brace element 17 be additionally installed. The brace, as shown in FIG. 1, has a hook 58 for extension through an opening 13 of the Pegboard 12, a stop segment 59 and a forwardly extending longitudinal section 61. A U-shaped clip 62 is provided on the main trunk support 14, and a lock pin 63 can be extended through openings in the downwardly depending sides of the U clip 62 for engagement through an eye 64 formed on the end of the brace 17. When the bracket 11 is being installed, the hook ends 18 and 58 cannot be engaged in the Pegboard simultaneously if a rigid construction is provided. Accordingly, the brace 17 is desirably a separate structure that will be applied to the bracket 11 by insertion of the pin 63 after the bracket 11 is in its installed position. Conversely, when the pin 63 is installed, the bracket and its brace cannot be removed from the board and, accordingly, the safety and security of the installation is improved by such construction.

The bracket 11 inclusive of only the described components provides a serviceable support that can be used for the display and sale of many different items. The forwardly and downwardly extending disposition of the main trunk component 14 and the echelon arrangement of the laterally extending support arms 15 provides a distributed type of positioning for sale items that are disposed one behind the other on the separate arm forepieces. A customer or merchandiser walking past the display can readily see each of the separate items stored on the bracket 11 and can, accordingly, know the extent of the supply available. If a selection of separate items that may be of different size, cross-section or construction is to be made, however, or if inventory control is desirable, additional display tab components are provided that will make the selection of individual items from a group of similar items easier. Inventory control and pricing will likewise be facilitated when such tabs are provided.

Figure 5:
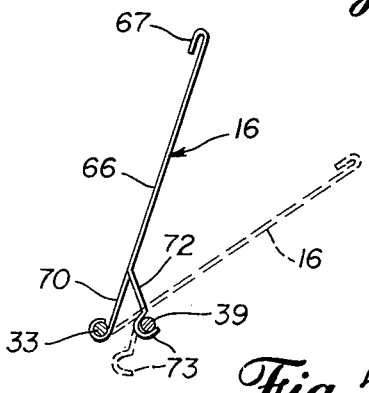
FIG. 5 is a side elevation showing the alternate positions for the index tabs.

The index tab components 16 shown in FIGS. 1, 2 and 5 are of special and additional utility in this particular bracket embodiment. The index tabs 16 shown are formed of strip material. A flat display panel 66 is provided on the outwardly and forwardly disposed face. The upper edge of the display tab has a return lip 67 that reinforces the plate structure and that also provides a receptacle for price tags, labels, index and part number tags or the like. The lower edge of the tab 16 is serrated by cuts 68 that provide separate hinge type loops 69 and 70 and latches 71 and 72. The hinge loops 69 and 70 are engaged with the extension flights 33 of the support arms 15 to facilitate pivotal movement of the index tab 16. The latches 71 and 72 have a lock end 73 that is brought into engagement with a lateral portion of the return flights 39 for the support arms. When the index tabs 16 are in the collapsed or storage configuration as shown by the dotted outline representation of FIG. 5, the lock 73 is disengaged, and the index tabs are substantially disposed along the main support trunk 14 of the brackets 11. In this position the brackets may be conveniently and compactly stored, handled and transported without damage. A pair of brackets can be nested one against the other in inverted positions to further conserve shipping and storage bulk.

When the bracket is assembled and/or installed on a Pegboard support, the index tabs 16 will be moved to the full line position shown in FIG. 5. When in this position, the display faces 66 of the separate index tabs 16 will all be easily observed, and any information displayed thereon or on preprinted cards held by return lips 67 can be easily seen by customers and merchandisers. If size, inventory and price information is disposed on such index tabs, the selection and replacement of separate items will be greatly facilitated. In addition to the compact storage and convenient display features, however, it is to be noted that the index tabs 16 actually provide outrigger support for the separate laterally extending portions of the separate arms 15. When the lock ends 73 are engaged with the return flights 39 and the index tabs 16 are in the display position, a greater number of items of heavier weight may be supported by the arms 15.

A further and alternate embodiment of the invention is shown in FIGS. 6 through 10. For this preferred embodiment the bracket 111 is of overall configuration similar to that of the bracket 11, but details of construction are slightly modified. As with the previous embodiment, bracket 111 is intended for use to extend forwardly and downwardly from a supporting board structure 112 in which the board openings 113 can be spaced identically with the openings 13 previously described. Bracket 111 has a main trunk support 114 that is again formed of No. 6 gauge wire. A stop segment 119 provided by the inwardly disposed end of the main support trunk 114 is welded to a cross bar 121 which is itself bent at its extremities to provide the hook ends 118. When the main trunk support is in its installed position, a pair of hooks 118 will be extended through openings 113 in the board, and the stop segment 119 will be disposed against the forward face of the board to hold the main trunk support 114 in the desired forwardly and downwardly extending position.

The support brace 117 is likewise of configuration similar to that for support brace 17. However, for this construction a stop segment 159 is provided on the end of the longitudinal extending section 161 for engagement against the forward face of the board when the hooks 158 are engaged through openings in the board. As in the previous instance, a U-shaped clip 162 is provided on the main trunk support 114 so that a lock pin 163 may be used to interengage the main support 114 and its support brace 117. When the pin is installed, the bracket 111 cannot be removed from its supporting wall.

Figure 6:
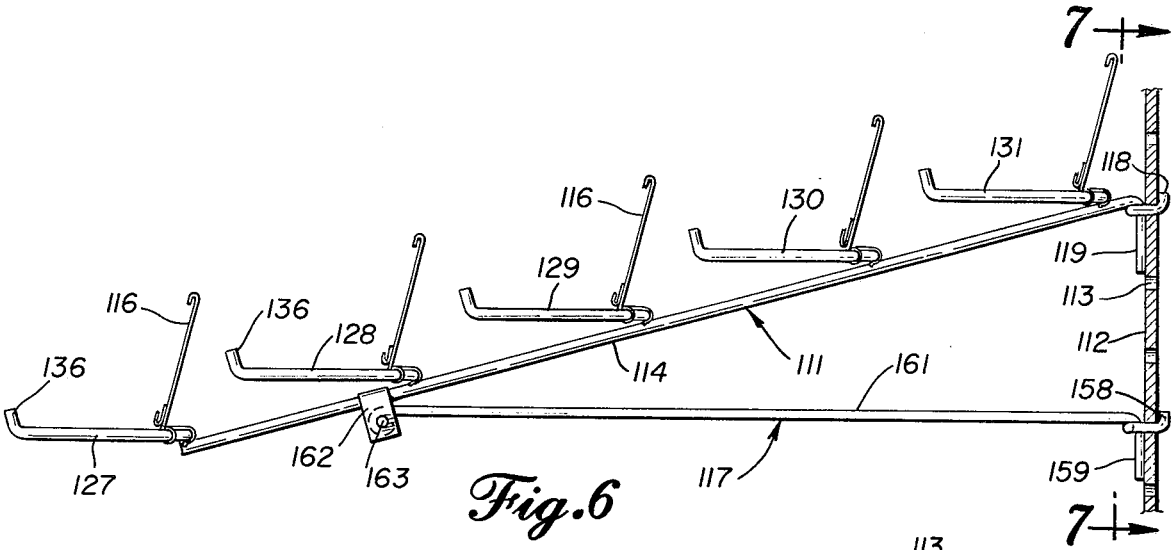
FIG. 6 is a side elevation showing a second bracket embodiment of the invention.
Figure 8:
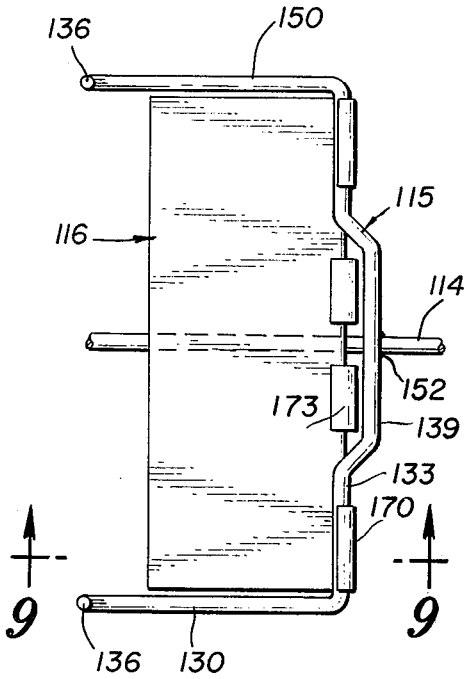
FIG. 8 is a partial top plan view showing features of the bent wire arms on the main trunk.
Figure 7:
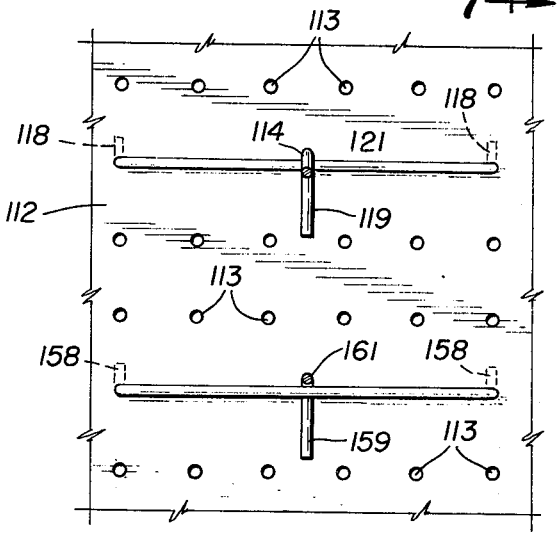
FIG. 7 is a front elevation taken along the line 7—7 of FIG. 6 showing the engagement of the bracket and a brace with a Pegboard support.
Figure 9:
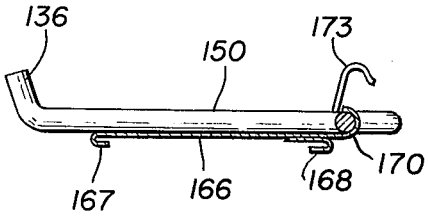
FIG. 9 is a partial side elevation taken along the line 9—9 of FIG. 8 showing further features of the bent arms and of an index tab in the stored position.
Figure 10:
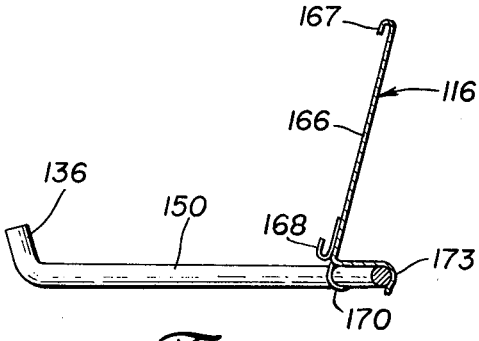
FIG. 10 is a side elevation similar to that of FIG. 9 showing the index tab structure in the display and arm support position.

In this alternately illustrated support bracket, the laterally extending arm components 115 have successive right forepieces or arms 127–131. The arm components 115 themselves are of changed, though comparable, configuration and structure. For this embodiment of the invention, the arms 115 are made of heavier gauge wire material that may be of the same cross-section as that for the main support 114 and brace 117. The construction of a single arm component 115 is shown in FIGS. 8, 9 and 10. For this support arm, upturned end stops 136 are disposed forwardly in a manner that will tend to retain items disposed on the left and right forepieces 150 and 130, respectively. Outwardly from the main truck support 114, the arm component 115 has an offset segment 139 and an extension segment 133. A weld 152 secures the center of the offset segment 139 to the main support trunk 114. When the main trunk is in its installed position as shown in FIG. 6, the forepieces (130, 150) of all of the arm components 115 are disposed horizontally.

In manner similar to that used for the previous embodiment, each of the arm components 115 is provided with an index tab structure 116. The construction for the index tab is similar to that provided in the earlier embodiment. The tab 116 has separate hinge loops and latches 170 and 173 with the loops 170 engaged to the extension segments 133 of arm 115 and with latch end 173 selectively engageable with offset segment 139. Such latch end 173 is shown in its disengaged position in FIG. 9 where the index tab 116 is in its nested configuration. The latch end 173 is engaged in FIG. 10 wherein the index tab 116 is in the display position. As in the previous construction, when the index tab 116 is in the display position, the tab structure tends to reinforce and help support the arm components 115 so that the forepieces, such as the forepieces 130 and 150, can support an increased load. In order to assure a secure interengagement between the latch ends 173 and the offset segment 139, the free ends of the latch are of hooked configuration so that a snap type or overcenter force transmitting engagement is assured.

The structure of index tab 116 itself again provides a flat display panel 166 and a return lip 167 at the upper extremity of the tab. A separate clip 168 is provided along the lower edge. Clip 168 may be spot welded in place to provide reinforcing for the tab structure as it further provides a mating receptacle adapted to support preprinted cards that may have index, inventory, price or other information displayed thereon.

FIG. 2 illustrates the use of the bracket assembly 11 for the storage and display of fan belts 75. Bracket embodiments 11 or 111 may be alternately or conjointly used for this type display. When either bracket embodiment is used for such purposes, a single bracket 11 or 111 can conveniently display up to 50 belts in an area of preperforated wallboard or Pegboard that may have previously only held from four to 16 belts. In the usual auto parts store a supply of even 50 fan belts would be inadequate, and, accordingly, it is fully contemplated that a plurality of support brackets 11 or 111 will be used in side-by-side and vertical disposition in order to provide a full stock of belts. If even 10 or 20 separate brackets are used, the total display will still be quite compact and yet all of the belts will be readily accessible for viewing or sale. If the index tabs 16 or 116 are provided and used, an immediate visual inventory control is provided that greatly facilitates reordering or stock control operations. The brackets described, of course, are adaptable for use in connection with display of very many different sale items that may be of quite different shape, size and weight. For all such uses the echelon positioning and lateral separation of the forepiece support elements provides improved visual and access advantages that will enhance sales potentials. The total combinations inclusive of index tabs that are disposed in a similar echelon arrangement further enhance the sale, inventory and pricing advantages of the invention, while the carrying capacity of the brackets is also improved.

I claim:

1. A bracket assembly for mounting on an upstanding support to hold and display items of merchandise comprising fastener means for engagement with said upstanding support, a main trunk component extending forwardly of said support when installed, a plurality of arms disposed in echelon positions along the length of said main trunk and extending laterally therefrom whereby a plurality of merchandise items may be displayed in dispersed positions on opposite sides of said main trunk for convenient viewing and access, said laterally extending arms being of formed wire construction with portions of the lateral segments of said arms being offset, index tab elements pivotally disposed on said laterally extending arms for movement to alternate display and storage positions, and means whereby said index tabs are selectively interconnectable to offset portions of said lateral segments whereby the arms are reinforced by said index tabs.

2. The bracket as set forth in claim 1 wherein said upstanding support is a pre-perforated panel board and further comprising a brace in contact with said support and extending forwardly therefrom, and means for selectively interengaging said brace and said main trunk at a forward position of intersection, with said fastener means comprising hook ends for said main trunk and brace for engagement through the perforated holes of said panel board and with said main trunk and brace being disposed at angular positions one with respect to the other whereby the hook ends of the bracket assembly are not removable when said brace and main trunk are interengaged.

3. The bracket assembly as set forth in claim 1 wherein said laterally extending arms are integrally formed of a continuous strand of wire providing offset extension and return flight segments and wherein said index tab elements in the display position are interconnected to both the extension and return flight segments of said arms whereby the arms are reinforced by said index tab.

4. The bracket assembly as set forth in claim 1 wherein said index tab in the display position is interconnected to offset portions of said lateral segments whereby the arms are reinforced by said index tab.

* * * * *